US008944264B2

(12) United States Patent
Frishman

(10) Patent No.: US 8,944,264 B2
(45) **Date of Patent: *Feb. 3, 2015**

(54) MEDICAL VIAL CAP

(71) Applicant: Abe Frishman, Carrollton, TX (US)

(72) Inventor: Abe Frishman, Carrollton, TX (US)

(73) Assignee: World Bottling Cap, LLC, Carrollton, TX (US)

( * ) Notice: Subject to any disclaimer, the term of this patent is extended or adjusted under 35 U.S.C. 154(b) by 63 days.

This patent is subject to a terminal disclaimer.

(21) Appl. No.: 13/758,623

(22) Filed: Feb. 4, 2013

(65) Prior Publication Data

US 2014/0217057 A1 Aug. 7, 2014

(51) Int. Cl.
*B65D 41/42* (2006.01)
*B65D 41/32* (2006.01)

(52) U.S. Cl.
CPC ..... *B65D 41/42* (2013.01); *B65D 41/32* (2013.01)
USPC ..... 215/255; 215/256; 215/328; 220/272; 220/273

(58) Field of Classification Search
CPC ..... B65D 41/42; B65D 51/20
USPC ..... 215/255, 256, 328; 220/272
See application file for complete search history.

(56) References Cited

U.S. PATENT DOCUMENTS 3,522,899 A * 8/1970 Garriques et al. ..... 215/255
4,004,705 A * 1/1977 Fujio ..... 215/246

* cited by examiner

*Primary Examiner* — Anthony Stashick
*Assistant Examiner* — Raven Collins
(74) *Attorney, Agent, or Firm* — Matthew E. Burr

(57) ABSTRACT

A crown, for a medical vial opening, has a top portion and a skirt surrounding the top portion. The skirt terminates at a lower edge defined in a first horizontal plane. An opener assembly is mounted to a portion of the top. A first scoring line extends from the portion of the top to which the opener assembly is mounted to the lower edge of the skirt in a continuous radial direction, and a second scoring line provides an upper radial segment extending from the opener assembly to the skirt along a radial axis, and a lower annular segment that extends circumferentially along the skirt in an annular direction and extending from a terminus of the upper radial segment, the lower annular segment defined in a second horizontal plane equidistant to the first horizontal plane associated with the lower edge of the skirt.

5 Claims, 2 Drawing Sheets

MEDICAL VIAL CAP

CROSS-REFERENCE TO RELATED APPLICATIONS

This application is related to, claims the benefit of and priority from co-pending U.S. patent application of the same title Ser. No. 12/725,295, Mar. 16, 2010, which in turn claims priority and the benefit of application Ser. No. 11/698,247 (now issued as U.S. Pat. No. 8,061,544) filed Jan. 24, 2007, the disclosures of which applications are incorporated herein by reference.

FIELD OF THE DISCLOSURE

The present disclosure relates to caps and crowns for medical vials and other containers, and in particular, to a manual pull-to-open vial cap.

BACKGROUND

A beverage bottle that opens manually with relative ease, without the use of a bottle opener, has been a long-felt need for beverage providers. Bottle caps must be tightly secured to the bottle opening to prevent spillage of the contents, loss of pressure (in the case of pressurized or carbonated beverages) and to maintain the hygienic conditions of the contents. The tight seal makes it difficult to open a bottle by hand.

The advent of the familiar twist-off bottle cap was a significant advance for manual bottle opening, but all too frequently one has to grip the cap so hard to twist the cap free that the points of the cap angels inflict pain on the hands or fingers. To protect the hands from injury, it is a common practice to wrap the bottle cap in the tail of a shirt or in a cloth before twisting the cap.

Bottle caps adapted with pull tabs, similar to those used for beverage cans, have been known in China and other territories of Asia. See, for example, International Patent Application PCT/CN00/00040 by Liu, priority date Mar. 4, 1999, International Publication No. WO00/51906. Such pull tab bottle caps, however, are notoriously difficult to open because they require the exertion of an uncomfortable amount of force to break the seal and then pull the tab back (tearing the metal or other material from which the cap is fabricated) to remove the cap.

Another pull-tab solution for bottle caps is known as the MaxiCrown® such as is described U.S. Pat. No. 4,768,667 issued Sep. 6, 1988, to Magnusson. The MaxiCrown® provides a pull ring disposed along the side of the neck of the bottle as an extension of the crown and thus is problematic for use with standard angel-crimping bottle capping machines. Indeed, a special capping machine is recommended to cap bottles with the MaxiCrown®.

There is a need, therefore, for a bottle crown that is easy to open manually yet which may be tightly sealed around the bottle opening using standard capping machines common in the art. Certain advantages of the bottle crown described in the patents and patent applications related to this application have been adapted here to medical vial caps, in particular the opener assembly and the score lines, which advantageously allow a medial vial cap to be opened in a manner comparable to the beverage bottle cap previously described.

SUMMARY

A crown, for a medical vial opening, has a top portion and a skirt surrounding the top portion. The skirt terminates at a lower edge defined in a first horizontal plane. An opener assembly is mounted to a portion of the top. A first scoring line extends from the portion of the top to which the opener assembly is mounted to the lower edge of the skirt in a continuous radial direction, and a second scoring line provides an upper radial segment extending from the opener assembly to the skirt along a radial axis, and a lower annular segment that extends circumferentially along the skirt in an annular direction and extending from a terminus of the upper radial segment, the lower annular segment defined in a second horizontal plane equidistant to the first horizontal plane associated with the lower edge of the skirt.

BRIEF DESCRIPTION OF THE DRAWINGS

The detailed description that follows, by way of non-limiting examples of embodiments, makes reference to the noted drawings in which reference numerals represent the same parts throughout the several views of the drawings, and in which.

DETAILED DESCRIPTION

In view of the foregoing, through one or more various aspects, embodiments and/or specific features or sub-components, the present disclosure is thus intended to bring out one or more of the advantages that will be evident from the description. The present disclosure makes reference to one or more specific embodiments by way of illustration and example. It is understood, therefore, that the terminology, examples, drawings and embodiments are illustrative and are not intended to limit the scope of the disclosure. The terms "crown" and "cap" may be used interchangeably in the description that follows.

Caps, also referred to interchangeably as crowns, are secured to the bottle opening by crimping the crown down over the open of the container in a series of concave arcs around the circumference of the opening. The arcs create sharp convex points between each concave arc. The arcs and points are often referred to by those skilled in art as "angels."

Figure 1:
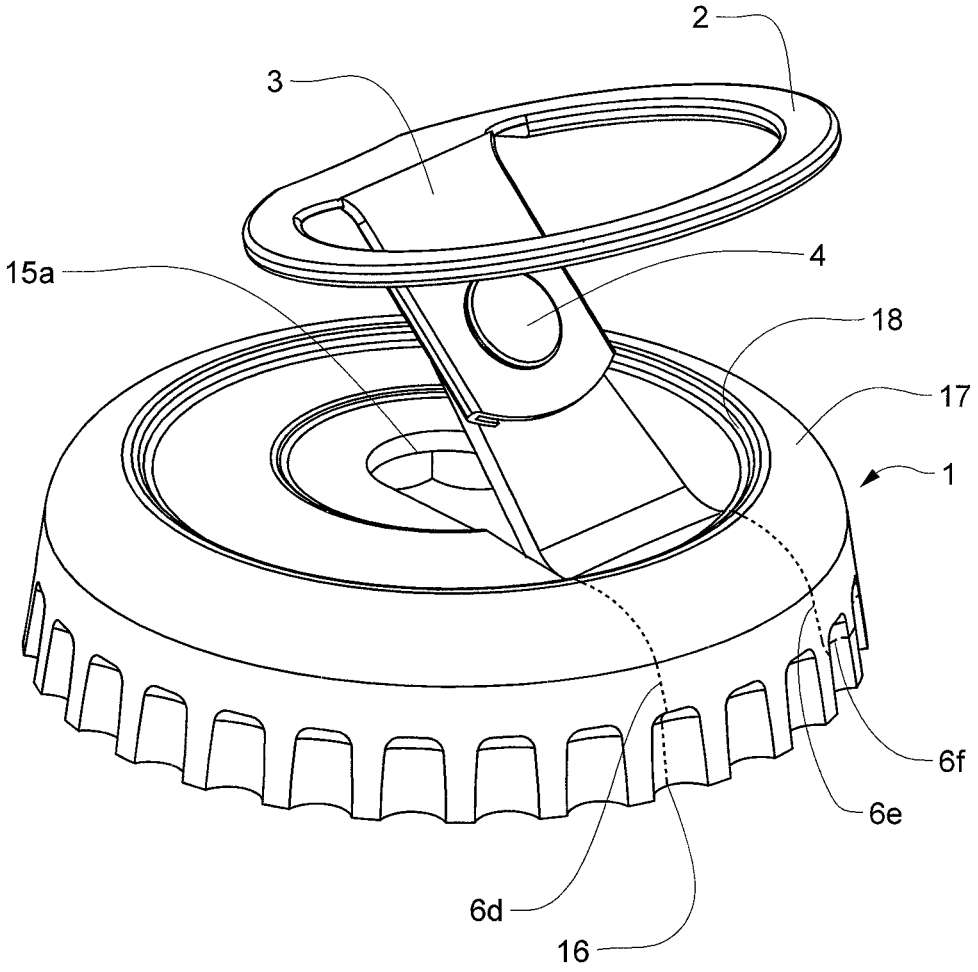
FIG. 1 is a diagrammatic illustration of an isometric top view of a beverage bottle cap having an opener assembly and score lines.

FIG. 1 is a diagrammatic illustration of an isometric top view of a beverage bottle cap having an opener assembly and score lines. The crown 1 is shown popped open in the center 15*a* with pull ring 2. Pull tab 3 is connected to crown 1 with rivet 4 and is in position to tear along cut lines 6*d* and 6*e* with application of manual force. One or more circular depressions 18 create space in the top 17 of crown 1 to seat pull ring 2 and the rest of the opener apparatus.

Figure 2:
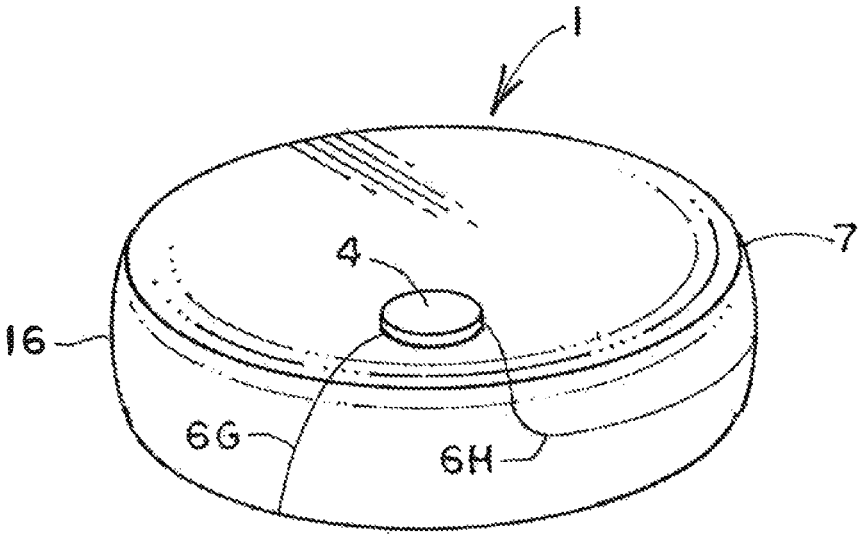
FIG. 2 is an isometric top view diagrammatic illustration of an alternative embodiment of the cap of FIG. 1 adapted to a medical vial cap of the present disclosure.

FIG. 2 is an isometric top view diagrammatic illustration of an alternative embodiment of the cap of FIG. 1 adapted to a medical vial cap of the present disclosure. Skirt 16 surrounds the top portion and terminates at a lower edge defined in a first horizontal plane. A first scoring line 6G extends from the portion of the top 7 to which the opener assembly is mounted to the lower edge of the skirt 16 in a continuous radial direction. A second scoring line has an upper radial segment extending from the opener assembly rivet 4 to the skirt 16 along a radial axis; and, a lower annular segment 6H extending circumferentially along the skirt 16 in an annular direction and extending from a terminus of the upper radial segment, the lower annular segment 6H defined in a second horizontal plane equidistant to the first horizontal plane associated with the lower edge of the skirt 16. The crown of FIG. 2 is similar to the crown of FIG. 1, except that for having no crimping angels. A crown of the embodiment of FIG. 2 is comparable to pressure-sealed crowns for fruit juices and the like, which curl over the top of a container without crimping. The opener assembly with rivet 4 is off-center, but otherwise crown 1 opens as previously described for FIG. 1.

Figure 3A:
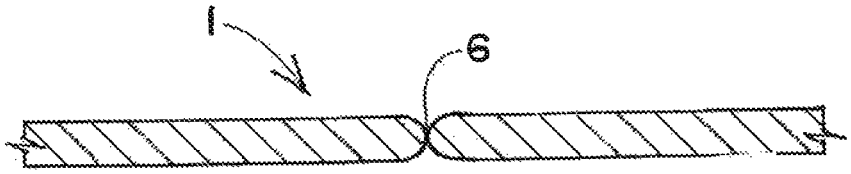
FIG. 3A is a cross-section schematic illustration of an unbroken score line of a crown of the present disclosure.
Figure 3B:
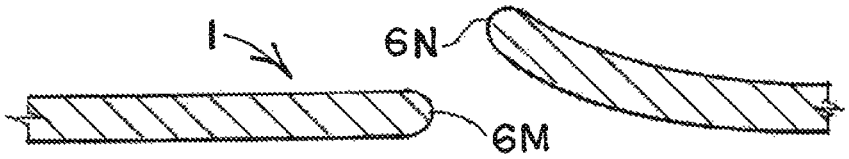
FIG. 3B is a cross-section schematic illustration of a broken score line of the embodiment of FIG. 3A.

FIG. 3A is a cross-section schematic illustration of an unbroken score line of a crown of the present disclosure. FIG. 3B is a cross-section schematic illustration of a broken score line of the embodiment of FIG. 3A. An advantageous safety feature of a crown of the present invention is achieved in the manufacture of score lines 6. Describing FIGS. 3A and 3B together, line 6 is scored on crown 1 in such a way that the moieties on either side of line 6 have curved edges 6M and 6N in cross-section profile. The seal formed by line 6 may be analogized the seal formed by pressing the fingers of opposing hands together. The tip of each finger is curved and when two fingers are brought together, a seal can be formed. When score line 6 in FIG. 24A is torn as one opens crown 1 using the opener assembly, crown 1 forms two edges 6M and 6N, which are curved or rounded, analogous to pulling the fingers apart.

The reason score line 6 of FIGS. 24A and 24B is advantageous is that is reduces the sharps produced by tearing open crown 1 with the opener assembly. Round tear edges 6M and 6N render the opened crown dramatically less dangerous from sharps than would otherwise be the case.

Further regarding score line 6, one consideration of a crown of the present disclosure is the ease with which the material of crown 1 can be torn once opened by the opener assembly. The ease of tearing relates to the amount of pull force that needs to be applied to tear the crown material. Pulling force may be reduced, that is, ease of tearing may be increased, with the use of crown coatings or lacquers known in the art that contain additives which increase the ease of tearing, by reducing the required pull force, of the crown 1 material along line 6.

A pulling force for a pull ring of the present disclosure of approximately 2.5 kg (kilograms) or less is preferred. A relatively small pull force such as this is recommended so that virtually everyone will have sufficient strength to open a bottle using a crown of the present disclosure. In contrast, a relatively large pull force has the disadvantage of requiring a great amount of initial force to tear the tinplate material, and once the cap material is torn open the sudden release of pulling force causes the bottle to jerk away from the user, spilling the contents often in dramatic fashion.

In addition to the low hardness of the tinplate, the thinness or gauge of the crown may also contribute to achieving a small pull force. For example, a crown of the present invention is recommended to have a thickness of less than 0.28 mm. Embodiments in which the crown material is strengthened by corrugation, such as in seated embodiments, may be thinner than standard crowns, having, for example, a gauge as thin as approximately 0.16 mm.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural, materials, and logical substitutions and changes may be made without departing from the scope of this disclosure. Figures are merely representational and may not be drawn to scale. Certain proportions thereof may be exaggerated, while others may be minimized Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the claims reflect, inventive subject matter lies in less than all features of a single disclosed embodiment. Thus the following claims are hereby incorporated into the Detailed Description, with each claim standing on its own as a separate embodiment.

The description has made reference to several exemplary embodiments. It is understood, however, that the words that have been used are words of description and illustration, rather than words of limitation. Changes may be made within the purview of the appended claims, as presently stated and as amended, without departing from the scope and spirit of the disclosure in all its aspects. Although description makes reference to particular means, materials and embodiments, the disclosure is not intended to be limited to the particulars disclosed; rather, the disclosure extends to all functionally equivalent technologies, structures, methods and uses such as are within the scope of the appended claims.

I claim:

1. A crown for a medical vial opening, the crown comprising:

a top portion;

a skirt surrounding the top portion and terminating at a lower edge defined in a first horizontal plane;

an opener assembly mounted to a portion of the top;

a first scoring line extending from the portion of the top to which the opener assembly is mounted to the lower edge of the skirt in a continuous radial direction; and a second scoring line comprising:

an upper radial segment extending from the opener assembly to the skirt along a radial axis; and, a lower segment extending along a portion of the circumference of the skirt in an annular direction and extending from a terminus of the upper radial segment, the lower annular segment defined in a second horizontal plane equidistant to the first horizontal plane associated with the lower edge of the skirt.

2. The crown of claim 1, wherein the opener assembly further comprises a pull tab having a tab riveted to the top portion of the crown and a pull tab ring extending from the tab portion.

3. The crown of claim 2, further comprising a rivet securing the pull tab to the top portion of the crown.

4. The crown of claim 2, the opener assembly further comprising a lever under the pull tab.

5. The crown of claim 1, further comprising an interior under portion opposite of and defined by the top portion and the skirt; a liner fastened to the under portion.

* * * * *